US006899130B2

(12) United States Patent
Liao

(10) Patent No.: US 6,899,130 B2
(45) Date of Patent: May 31, 2005

(54) BILATERAL POWER PUMP UNIT

(75) Inventor: Po-Lin Liao, 12 Arrivo Dr., Mission Viejo, CA (US) 92692

(73) Assignee: Po-Lin Liao, Taichung (TW)

( * ) Notice: Subject to any disclaimer, the term of this patent is extended or adjusted under 35 U.S.C. 154(b) by 24 days.

(21) Appl. No.: 10/208,600

(22) Filed: Jul. 30, 2002

(65) Prior Publication Data

US 2004/0020539 A1 Feb. 5, 2004

(51) Int. Cl.[7] ..... F04B 17/00

(52) U.S. Cl. ..... 137/565.29; 417/410.1; 417/423.6

(58) Field of Search ..... 137/565.29, 565.3, 137/565.31; 417/405, 410.1, 410.3, 423.6, 423

(56) References Cited

U.S. PATENT DOCUMENTS 537,384 A * 4/1895 Cook ..... 417/405
2,083,167 A * 6/1937 Lamere ..... 417/405
2,282,256 A * 5/1942 Smelik ..... 417/423.6
2,543,564 A * 2/1951 Bakewell ..... 137/565.29
2,549,472 A * 4/1951 Isreeli et al. ..... 137/565.33
2,759,665 A * 8/1956 Wilber ..... 417/410.1
2,779,291 A * 1/1957 Albright ..... 417/405
3,009,442 A * 11/1961 Juvinall ..... 417/410.1
3,040,664 A * 6/1962 Hartley ..... 417/405
3,645,094 A * 2/1972 Suggs ..... 137/565.29
4,105,372 A * 8/1978 Mishina et al. ..... 417/423.6
4,121,418 A * 10/1978 Kronogard ..... 417/405
4,712,983 A * 12/1987 Moynihan ..... 417/234
4,799,870 A * 1/1989 McMaster ..... 418/151

* cited by examiner

*Primary Examiner*—John Rivell

(57) ABSTRACT

A bilateral pump unit comprises a housing including first, second, third, and bottom walls jointly defining a receiving space therebetween. A power input is attached to the first wall and having an output arranged in the receiving space. A first pump is attached to the second wall and providing first input and output ports, the first pump is coupled to the output of the power input through an input of the first pump. A second pump is attached to the third wall and provides second input and output ports, the second pump includes an input mechanically coupled to the input of the first pump.

3 Claims, 5 Drawing Sheets

BILATERAL POWER PUMP UNIT

FIELD OF THE INVENTION

The present invention relates to a power pump unit, and more particularly to a bilateral power unit in which a pair of power pumps are interconnected through a robust driving mechanism thereby providing bilateral output.

DESCRIPTION OF THE PRIOR ARTS

A conventional pump generally includes a pumping device coupled to a motor. When the motor is triggered, the pumping device is driven to rotate thereby creating a thrust for sucking a working liquid into the pumping device from one end, and ejecting the working liquid from the other end and then delivered to intended position. Generally, the motor and the pumping device are permanently fixed together thereby reducing its flexibility as well as increasing its cost.

U.S. Pat. No. 6,167,907 issued to Liaw discloses a typical pump. As shown in FIG. 1, a power transfer pump includes a rotary pump disposed within connected body sections comprising a top body, a main body with two ports and a cylindrical chamber to house a rotary assembly, a supporting body fitted with a connecting head, and a mounting body. The mounting body has a flexible ring, a bolt and forms a drive motor chamber with the supporting body to receive and clamp a power source that engages with the rotary assembly to activate the pump. The power transfer pump integrates into an oil removal station whereby by means of the rotary pump assembly, an oil sucking and discharging effect is created.

However, the Liaw's device provides only a unilateral power output which is far from the requirement of the existing market. For example, the power steering system of a vehicle needs to drain out the used working liquid and pour in the new working liquid simultaneously so as to prevent "air trap" within the steering system. In order to facilitate the drain out/pour in operation simultaneously, two conventional pumps have to be operated in synchronization. As such, the operation procedures become complicate and no doubt increase the running cost. Accordingly, there is a need for a pump which can facilitate bilateral operation cycle to meet the market requirement.

SUMMARY OF THE INVENTION

It is an object of this invention to provide a bilateral power pump unit in which the pump unit can work on different working liquids simultaneously.

In order to achieve the object set forth, a bilateral pump unit in accordance with the present invention comprises a housing including first, second, third, and bottom walls jointly defining a receiving space therebetween. A power input is attached to the first wall and having an output arranged in the receiving space. A first pump is attached to the second wall and providing first input and output ports, the first pump is coupled to the output of the power input through an input of the first pump. A second pump is attached to the third wall and provides second input and output ports, the second pump includes an input mechanically coupled to the input of the first pump.

Other objects, features of the invention will become more apparent from the following detailed description when taken in conjunction with the accompanying drawings.

DETAILED DESCRIPTION OF THE PREFERRED EMBODIMENT

Figure 1:
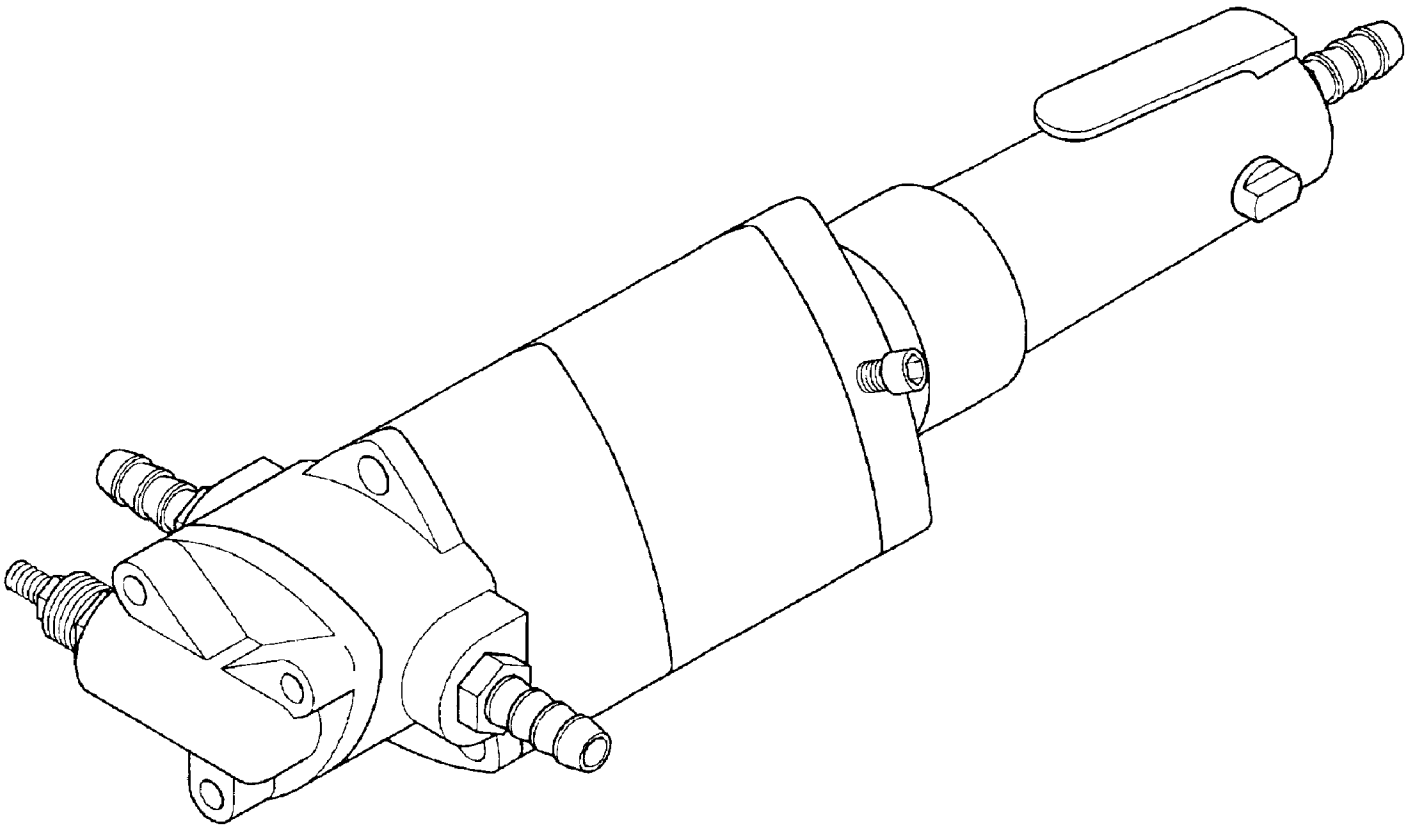
Prior Art Fig 1
FIG. 1 is a typical drawing showing a convention pump device disclosed by U.S. Pat. No. 6,167,907.
Figure 2:
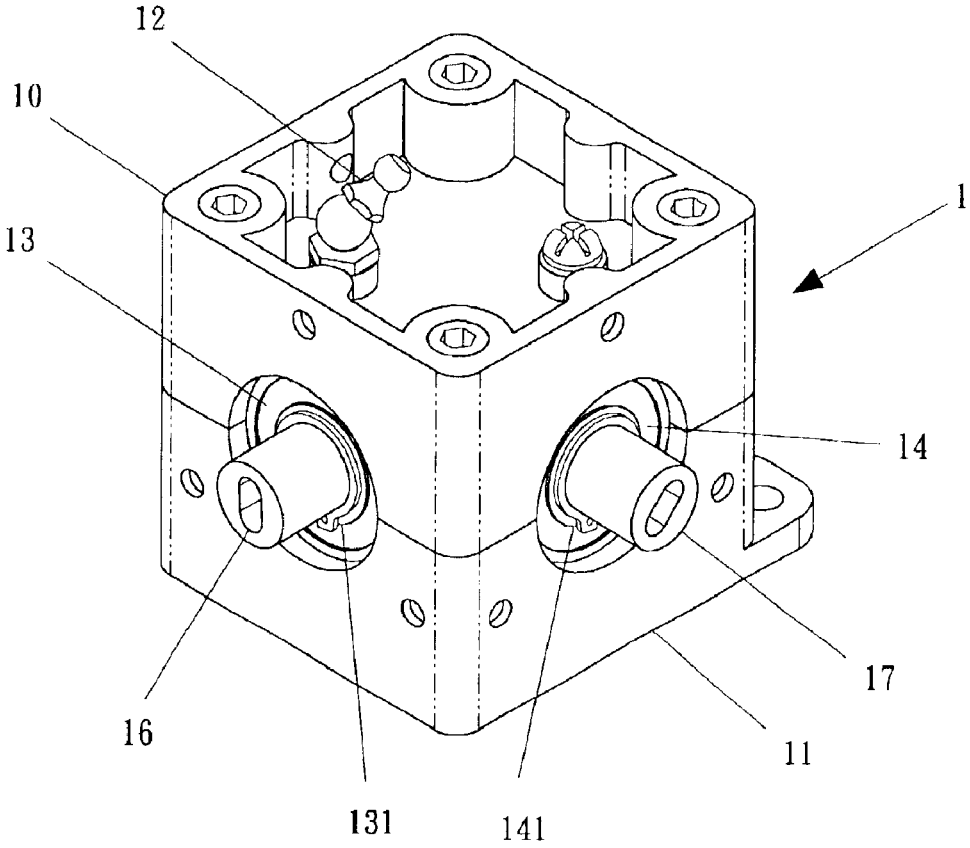
FIG. 2 is a perspective view of a driving mechanism of a bilateral pumping unit in accordance with the present invention.
Figure 3:
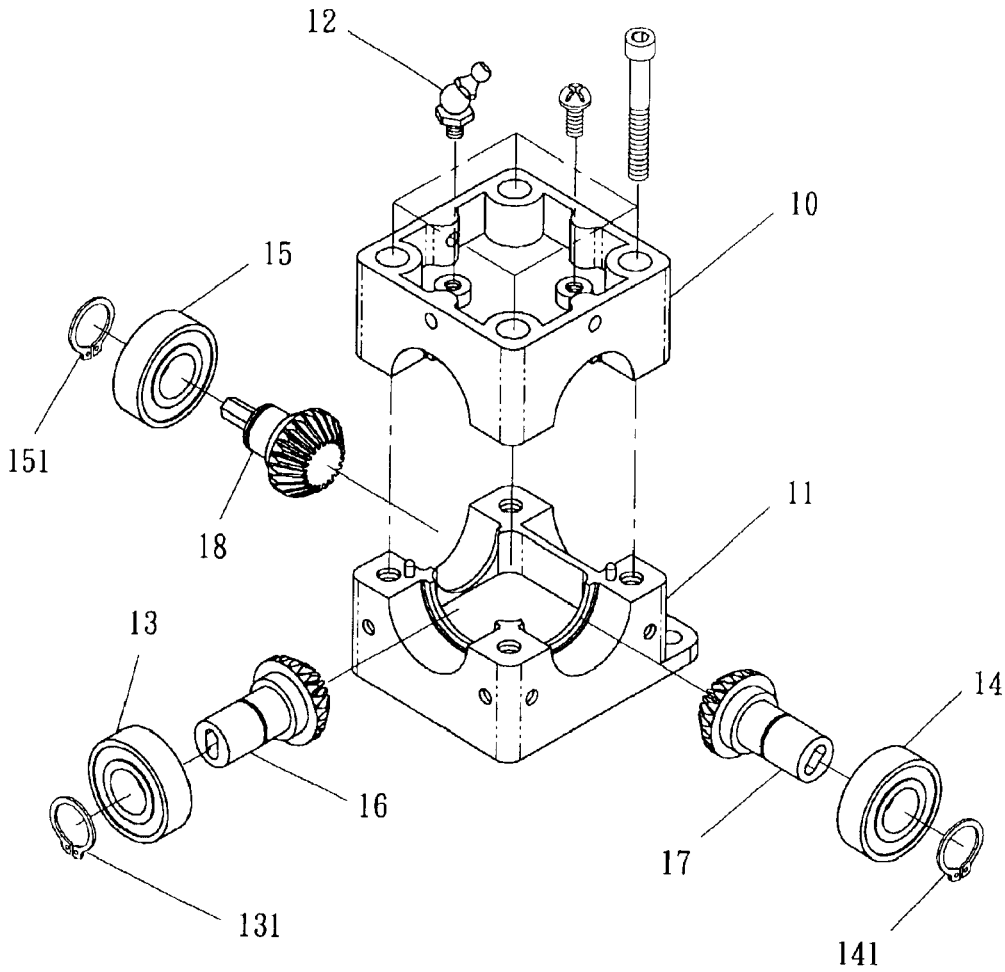
FIG. 3 is an exploded view of FIG. 2.
Figure 4:
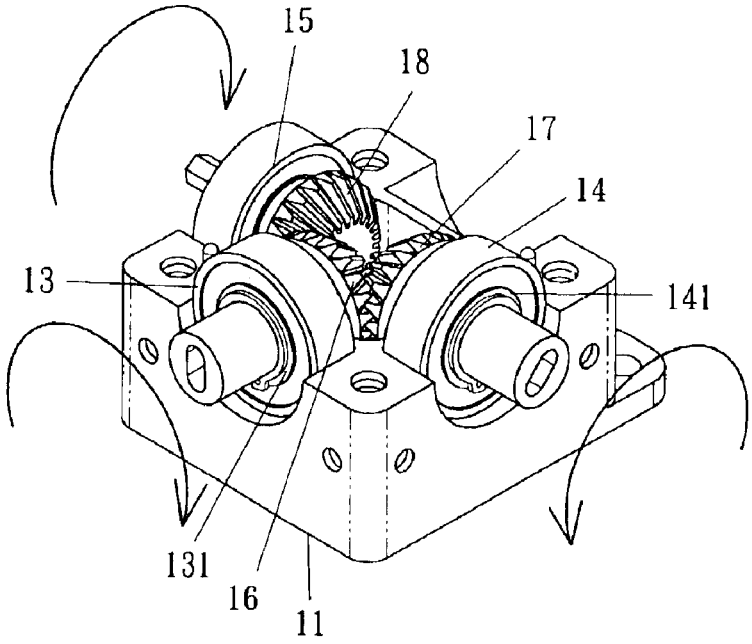
FIG. 4 is similar to FIG. 2 with parts removed for simplicity.
Figure 5:
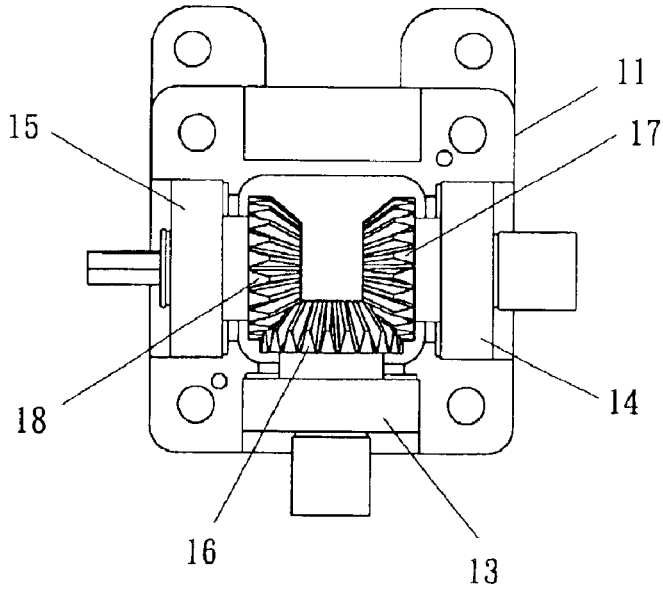
FIG. 5 is a top plan view of FIG. 4.

Referring to Figures, especially FIG. 2, a driving mechanism 1 in accordance with the present invention includes an upper casing 10, and a lower casing 11 attached to the upper casing 10. The upper and lower casings 10, 11 are assembled by bolts and blind threaded holes. The mechanism 1 further includes a grease inlet 12 for receiving grease therein so as to lubricate the moving parts arranged therein. The mechanism 1 includes first, second and third walls (not labeled) and each is provided with a cutout for mounting a corresponding bearing (13, 14, and 15) therein. The bearings 13, 14, and 15 are securely positioned in place by C-clips (131, 141, and 151). Each bearing (13, 14 and 15) is further mounted with a solar gear (16, 17, and 18) in which the solar gear 18 acts as a driving gear, while the solar gears 16 and 17 are following gears which are driven by the solder gear 18. All the solar gears 16, 17 and 18 are mechanically coupled together within the casing 10, 11, as clearly shown in FIGS. 4 and 5.

Figure 6:
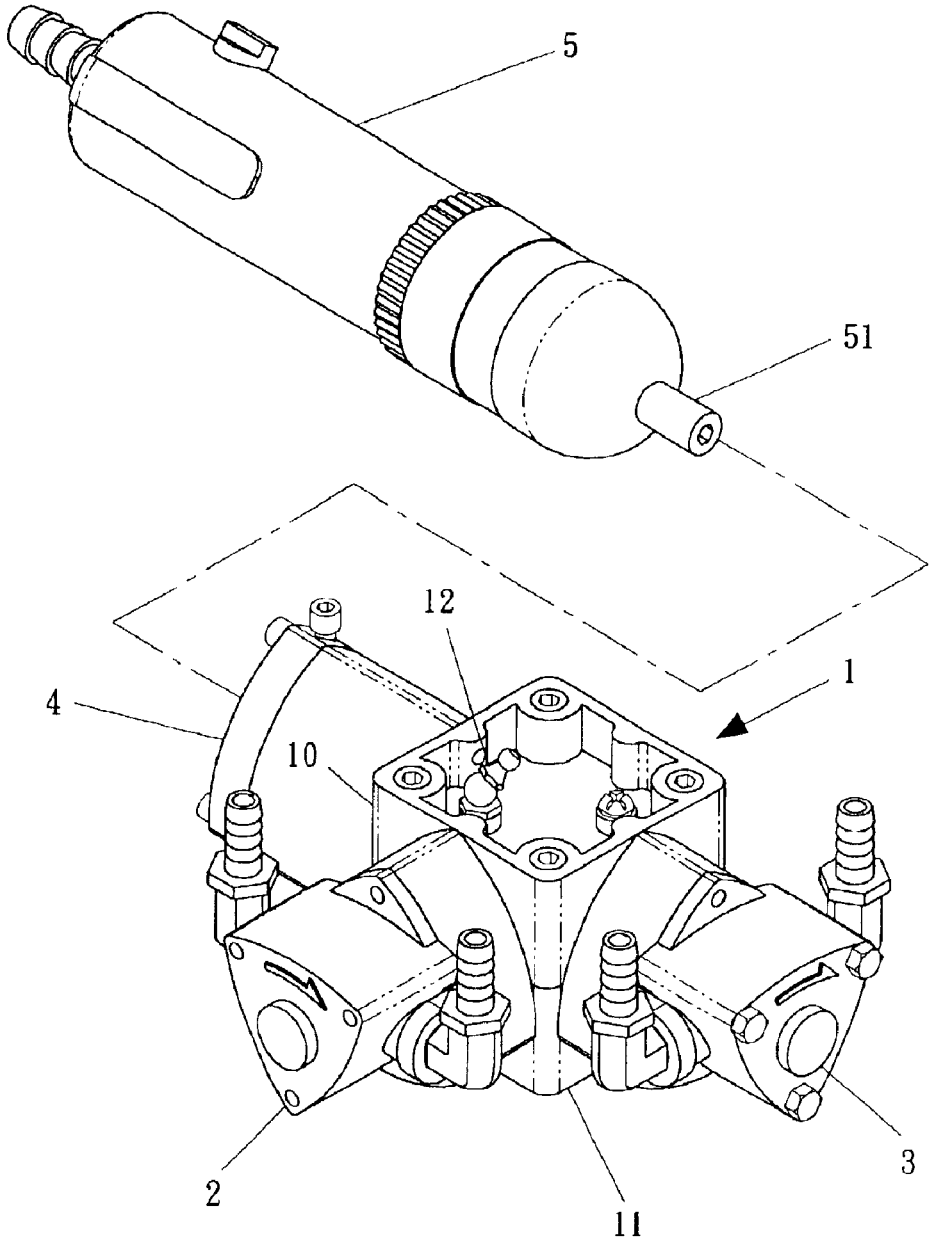
FIG. 6 is a perspective view of the bilateral power pump unit.

From the forgoing description, it is understandable that when the solar gear 18 is driven by a power source, such as a motor, the following gears 16 and 17 are driven accordingly with different direction. As shown in FIG. 6, the solar gears 16 and 17 are coupled to first and second pump units 2 and 3. By the arrangement, the first and second pump units 2 and 3 may work on different working liquids simultaneously. For example, the first pump unit 2 may pump out the used oil in a power steering system of a vehicle, while the second pump unit 3 my pump in new oil. This can never be achieved by a single conventional pump unit.

On the other hand, the driving mechanism 1 can be mounted with a coupler 4 adjacent to the driving solar gear 18 for mounting of a pneumatically operated tool 5. As such, the bilateral power pump unit can be operated both electrically or pneumatically.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

I claim:

1. A bilateral pump unit, comprising:

a housing including first, second, third, and bottom walls jointly defining a receiving space therebetween;

a power input attached to the first wall;

a first pump attached to the second wall and providing first input and output ports, the first pump being coupled to the power input;

a second pump attached to the third wall and providing second input and output ports, the second pump being mechanically coupled to the power input; and wherein the power unit, the first and second pumps are inter-coupled through a solar gear system.

2. The bilateral pump unit as recited in claim 1, wherein the solar gears system are arranged within the receiving space defined in the housing.

3. A bilateral pump unit, comprising:

a housing including first, second, third, and bottom walls jointly defining a receiving space therebetween;

a power input attached to the first wall and having an output arranged in the receiving space;

a first pump attached to the second wall and providing first input and output ports, the first pump being coupled to the output of the power input through an input of the first pump; and a second pump attached to the third wall and providing second input and output ports, the second pump including an input mechanically coupled to the input of the first pump.

* * * * *